United States Patent [19]

Byland

[11] Patent Number: 4,541,225

[45] Date of Patent: Sep. 17, 1985

[54] STRETCH FILM PACKAGE WRAPPING METHOD AND APPARATUS

[76] Inventor: Henry L. Byland, 4876 Parliament Way, Dunwoody, Ga. 30338

[21] Appl. No.: 418,548

[22] Filed: Sep. 15, 1982

[51] Int. Cl.[4] ..... B65B 11/10

[52] U.S. Cl. ..... 53/441; 53/466; 53/556; 53/586; 53/206; 53/228

[58] Field of Search ..... 53/460, 466, 463, 206, 53/210, 228, 229, 441, 556, 586

[56] References Cited

U.S. PATENT DOCUMENTS

| | | | |
|---|---|---|---|
| 2,882,665 | 4/1959 | Cross | 53/228 X |
| 2,917,886 | 12/1959 | Stremke | 53/206 |
| 2,926,473 | 3/1960 | Byland | 53/206 |
| 3,224,161 | 12/1965 | Conti | 53/586 X |
| 3,293,826 | 12/1966 | Hansen | 53/228 |
| 3,589,100 | 6/1971 | Konars | 53/229 X |
| 4,033,089 | 7/1977 | Bylan | 53/210 X |
| 4,134,246 | 1/1979 | Michels | 53/210 X |

FOREIGN PATENT DOCUMENTS

| | | | |
|---|---|---|---|
| 2748541 | 5/1978 | Fed. Rep. of Germany | 53/229 |
| 2370636 | 7/1978 | France | 53/206 |
| 1594939 | 8/1981 | United Kingdom | 53/556 |

*Primary Examiner*—John Sipos

*Attorney, Agent, or Firm*—Hill, Van Santen, Steadman & Simpson; Hill, Van Santen, Steadman & Simpson

[57] ABSTRACT

A machine for automatically wrapping in stretch plastic film a shallow tray filled with irregularly shaped contents comprises, in sequence of operation, a horizontally directed feed table means by which articles to be wrapped are fed into the machine, a film feed station, a girth wrapping station, a side wrapping station, and a discharge or delivery conveyor for conducting a fully wrapped and sealed article out of the machine. The machine is capable of operating continuously, handling a consecutive seriatim flow of articles therethrough. The film feed station comprises a vertically reciprocable film clamp and support arm for raising a sheet of stretch film transversely across the travel path of the article to be wrapped. The article passes through the curtain of film and into the girth wrapping station, causing the lower edge of the film to be folded beneath the bottom of the article tray. In the girth wrapping station, the upper edge of the film is tensioned and tucked underneath the article tray, forming an end-to-end wrap of the article in self-sealing fashion. The end-to-end wrapped article is then conducted into the side wrapping station, whereupon the transversely overhanging sides of the film are stretched and tucked underneath the bottom of the tray to form a fully wrapped and sealed article. The fully wrapped article is then conducted to the discharge conveyor for exit from the machine.

11 Claims, 15 Drawing Figures

STRETCH FILM PACKAGE WRAPPING METHOD AND APPARATUS

BACKGROUND OF THE INVENTION

1. Field of the Invention

The present invention relates to a method and apparatus for packaging and, more particularly, relates to a method and apparatus for automatically wrapping each of a series of open trays filled with suitable articles in plastic film material.

2. The Prior Art

Automatic wrapping machines have found wide use for packaging articles in a thin, clear, and tough plastic film. A major use of such machines is found in retail food stores, wherein plastic or fiber trays are filled with meat or vegetable products and sealed on all sides by a thin plastic wrap. The wrap contains the contents and protects them against contamination and also facilitates handling and sale of the product. Such wrapping of produce is done at the retail site, where machines are frequently operated by relatively inexperienced personnel. This requires that the machines be simple to use and safe, as well as efficient and quick in operation.

Illustrative of the prior art is U.S. Pat. No. 3,378,990 which discloses a modern, compact semi-automatic wrapping machine. U.S. Pat. No. 3,791,101 discloses placing a film curtain across the path of advance of a package, whereby motion of the package from one support surface to the next wraps the front, bottom, and top of the package in the plastic film for subsequent formation of a lap seam on the rear of the package. U.S. Pat. No. 4,033,089 concerns a wrapping machine in which the tray advances horizontally fully at one level through the machine and a retractable tucker and undersealer device passes beneath the tray to join opposed ends of the film in a lap joint along the bottom of the tray.

Typically, plastic film shrinkage is employed to tightly seal the film about the tray. In accordance with this technique, plastic film is heated, placed about an article, and allowed to cool resulting in the film material shrinking tightly about the article. Such heat shrinking packaging machines are necessarily further complicated by the inclusion of film heating equipment.

The present invention is directed to an automatic wrapping machine adapted to resiliently stretch plastic film material about an article being packaged, thus eliminating heat shrinking mechanisms. The inventive arrangement enables articles to be passed consecutively in seriatim through the machine wrapping stations in an automatic fashion and permits consistent handling of the articles for producing sealably wrapped products, such as in a supermarket.

SUMMARY OF THE INVENTION

A machine for automatically wrapping shallow trays filled with irregular contents in a plastic film utilizes suitable stretch film material, which is cheaper than heat shrink film, and operates without film heating devices. The machine comprises, in sequence, a film feeding station, a girth or end wrapping station, and a side wrapping station through which trays are advanced one at a time between loading and discharge conveyors. In the film feed station, film length is passed transversely to a path of advance of the tray and prevented from prematurely catching upon the tray by a pressurized air stream directed onto the film from the side of advance of the tray. The tray is advanced horizontally into the film for passage into the girth wrapping station, during which feed rolls feed sufficient film to encircle the package completely or almost completely. The film is then cut and the original free end of the film draped over the tray package such that a free-hanging end piece of film extends from the rear edge of the tray. In the girth wrapping station, the front edge of the tray is disposed against a releasable stop or abutment bar to prevent further advance of the tray in the station while a chain-driven underfolder bar passes beneath the tray in a direction from rear to front for stretching and tucking the free-hanging portion underneath the bottom of the tray. A resilient clamp means serves to secure the lower, cut edge of the film beneath the leading edge of the tray during this longitudinal or girth wrapping. After the underfolder bar has passed beyond the leading end of the tray, the stop bar is released and a chain-driven pusher bar engages the tray rear edge to pass the girth wrapped tray to the side wrapping station. In the side wrapping station, the open sides or tube ends of the film are positioned between overhead reciprocable folding bars and an underneath resiliently disposed guide ramp. The folding bars descend and clamp the tube ends of the film against the upper surfaces of the guide ramps, causing the film to be pulled downwardly from and along the opposed side edges of the tray. A pair of side underfolder rams then move laterally inward from opposed sides of the tray to engage the downwardly extending film tube ends and stretch the film transversely across the tray and contents from along the bottom of the tray. Further inward movement of the underfolder rams tucks the side edges of the film against the already folded film edges at the bottom of the tray. These side underfolder rams are withdrawn after the film has been transversely wrapped and sealed, leaving the tray fully wrapped and ready for transfer from the side wrapping station to the discharge conveyor, which may be heated.

The operation of the inventive wrapping machine enables filled trays to be wrapped with stretch film automatically one at a time in consecutive sequence. Suitable control means are used to automatically conduct and position each tray in the various stations of the machine and properly sequence the wrapping operations.

DESCRIPTION OF THE PREFERRED EMBODIMENT

Figure 1:
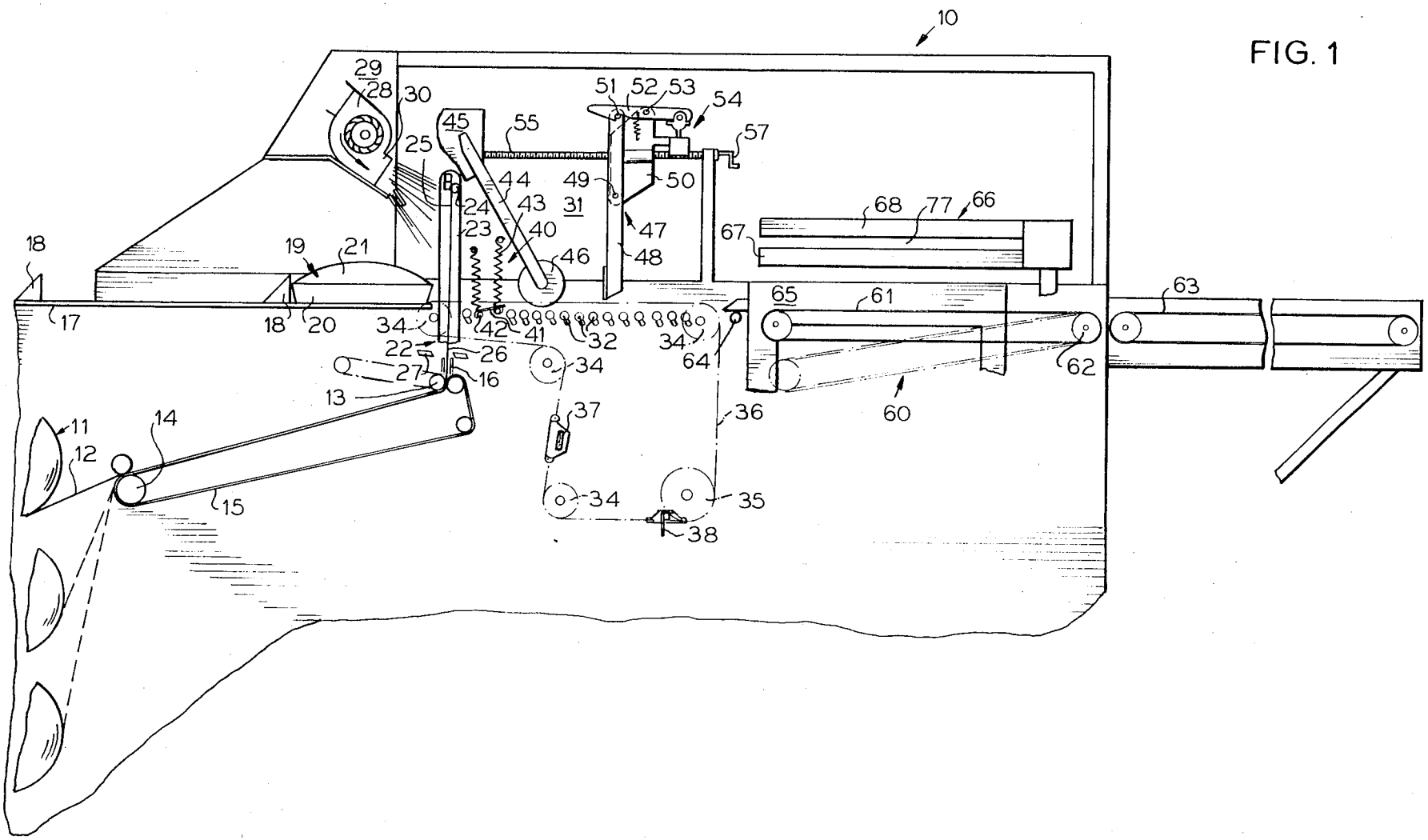
FIG. 1 is a schematic, cross-sectional side elevational view illustrating an automatic wrapping machine constructed in accordance with the present invention.

An automatic wrapping machine 10 embodying the present invention is illustrated in FIG. 1. The machine 10 utilizes a suitable supply magazine 11 which may include plural rolls of a coiled length of stretch plastic film 12, such as a thin, clear, PVC plastic film, for wrapping individual containers or trays containing irregular contents, such as chicken, fresh meat, fish, fruit, or vegetables. The stretch plastic film is known to be of a type which clings to itself upon tucking for sealing without requiring conventional heat shrink devices and operations and is generally cheaper than heat shrink film. The film 12 is unwound from one supply roll and conducted to a pair of suitably driven film feed rollers 13 via undersurface driving engagement on one belt-type conveyor means in which a continuous belt 15 is threaded about suitable rolls and at least one driven roll 14. The unique characteristics of stretch film, as opposed to, for example, heat shrink film, enable it to be reliably conveyed by a belt engaging only one side of the film. The leading edge of the film is thus passed to a point between a fixed pair of film guide fingers 16 for subsequent pick-up and use in the machine 10 in the manner disclosed more fully below.

A mechanism to permit selection of a correct width of plastic film 12 from the plural film supply rolls may be provided. Generally, a large number of similar width trays will be wrapped at one time, minimizing the need for automatic film roll selectors.

Beginning at the left end of FIG. 1, a feed table 17 is provided extending in the horizontal direction and receiving slidably and reciprocably thereon a pair of longitudinally spaced feed fingers 18. The fingers 18 retract into the feed table 17 on their leftward movements, so that successive articles 19 to be wrapped placed on the table will be passed to the right. The feed fingers 18 simultaneously alternate in back and forth movement along the table 17 for passage of a consecutive series of articles 19 into the wrapping machine 10. A crank on the driveshaft means (not shown) used to operate the fingers serves to alternate the back and forth movements of the feed fingers 18.

The article 19 to be wrapped comprises a shallow tray or container 20 made of pressed fiber, plastic, or any similar material capable of holding its own shape. The tray 20 is generally rectangular in shape having four sides and a bottom, although the inventive wrapping machine is equally applicable to round or other shaped containers. Placed in the tray 20 is a mass of contents 21 which are desired to be wrapped. Although the article 19 is shown rounded like a pie or a patty of ground meat, the inventive wrapping operation is equally applicable to irregularly-shaped articles, such as whole chickens, fruit, or machine parts.

Immediately adjacent the lead end of the feed table 17 is a film handling station 22 comprising a vertically movable, upstanding film clamp and support arm 23 which carries at its upper free end a releasable grip means 24, adapted to grasp and retain an upper free edge 25 of plastic film 12. Suitable film feed control means, such as sensing switches or a photoelectric control, sense container length and signal the feed rollers 13 and drive roll 14 for the belt conveyor for drawing a proper length of film 12 for wrapping of the article 19. The film clamp arm 23 is vertically reciprocable with respect to the pair of film feed rollers 13 located beneath the lead end of the feed table 17. Initially, the upper edge of the plastic film 12 is extended to the clamping mechanism 24 through the feed rollers 13 and guide fingers 16 when the film support arm 23 is brought to its lowermost position in the machine 10. The feed rollers 13 apply a tension to the film 12 toward a lower edge 26 of the film 12, after the gripping mechanism 24 of the reciprocable arm 23 has engaged the upper free edge 25 of the film and begins to ascend drawing the film upward with it. A pair of film cut knives 27 is provided on opposed front and rear sides of the film 12 to sever the film sheet and to form the free end of the lower edge 26 at a proper point in the machine operation sequence.

Arranged upwardly from the lead end of the feed table 17 is a blower 28 which is supported by a wall 29 of the machine in any convenient manner to direct a wide stream of air across the entire surface of the plastic film 12 from the side from which the article 19 advances thereinto. Preferably, the blower 28 has a discharge outlet 30 which is wider than the width of the plastic film 12 taken in the direction laterally transverse to the direction of horizontal movement of the article 19 through the machine 10. Although the blower 28 is shown as a self-contained centrifugal blower, any suitable source of a stream of pressurized air may be employed.

Immediately downstream from the vertically reciprocable film clamp arm 23 is a girth wrapping station 31. Located substantially at the horizontal plane of the feed table 17 is a series of transversely-extending support rollers 32 which serve to define a support plane over which the article 19 can be horizontally moved through the machine. The support rollers 32 are spaced slightly apart in the longitudinal direction to permit free, idling rotation thereof. Each roller 32 is spring-biased and supported for movement between the ends of generally vertically directed slots 33. In this manner, the rollers 32 can be cammed vertically downward from their normal raised positions with movement of an object running thereover.

Threaded about suitable guide 34 and drive 35 rollers is a pair of transversely spaced, continuous drive chains 36 (one of which is shown in FIG. 1) suitably connected for running in timed sequence with the back and forth movement of the feed fingers 18 or, alternatively, arranged of a predetermined length to permit continuous operation thereof. Extending transversely between the chains 36 from suitable opposed end connection means mounted at common points along each of the chains is an underfolder bar device 37 disposed a predetermined distance behind the underfolder bar 37 (relative to the direction of movement of the chains 36) is a transversely extending pusher bar 38 having opposed ends mounted in suitable connection means disposed at common points along each of the chains 36. The underfolder bar 37 and the pusher bar 38 are driven via the drive chains 36 for periodic movement over and along the support plane defined by the support rollers 32, these elements passing from left to right, as shown in FIG. 1, along that plane.

There is also provided in the girth wrapping station 31 a clamping mechanism 40 comprising a transversely extending pressure plate 41 hinged at its tail end about a pivot bar 42 supported in slots 33 and biased upward at each end by coil springs 43 connected thereto. The pressure plate 41 is normally disposed within the travel path of the article 19 over the support rollers 32. In this manner, the pressure plate 41 is resiliently biased against the bottom of the article tray 20 upon its positioning in the girth wrapping station for purposes described more fully below.

Substantially overlying the clamping mechanism 40 is a freely rotatable lever arm 44 hinged at its upper end in a wall 45 and provided at its lower end with a transversely extending free-wheeling roller 46, preferably provided with a back-stopping clutch. The roller 46 serves to ride over the film 12 as it is draped and wrapped about the article 19 in the station 31. The weight of the roller serves to prevent backward tilting and sliding of the article 19 as it is end-to-end or girth wrapped and sealed. The roller action also provides a smoothing out action on the film. The roller 46 is preferably made of soft plastic or has an exterior rubber covering.

A releasable stop or abutment means 47 is also disposed in the girth wrapping station. The stop means 47, as shown in FIG. 1, comprises a vertically extending abutment bar 48 which is hinged at a transversely extending pivot rod 49 disposed in a carriage bracket 50. The abutment bar 48 is locked against pivotal movement, as shown in FIG. 1, by virtue of a transverse pin 51 connected at the upper end of the abutment bar which is releasably received in a suitable recess of a pivotable grip arm 52, hinged intermediately therealong on a transversely extending pivot rod 53 connected at an upper end of the bracket 50. The base end of the grip arm 52 is pivotally connected to the free end of a solenoid-operated piston-cylinder actuator 54. The grip arm 52 is normally biased into a locked position with the pin 51 of the abutment bar by virtue of a spring connection 55. The grip arm releases its grasp on the locking pin 51 when the solenoid 54 is actuated, causing the base end of the grip arm to descend and thus raising the locking recess end of the arm out of engagement with the pin 51. When the locking pin 51 is released from engagement with the grip arm recess, the abutment bar 48 is free to pivot about its axis defined by the rod 49 such that the article 19 is free to advance out of the girth wrapping station 31. In its locked position, the abutment bar 48 serves to prevent unexpected advance of the article 19 in the girth wrapping station during carrying out of end-to-end wrapping of the article with the plastic film. In order to accommodate articles of different length in the girth wrapping station, positioning of the stop means 47 is made horizontally adjustable by virtue of a threaded shaft 56 which is received through a cooperatively threaded bore formed in the stop means bracket 50. The threaded shaft is horizontally disposed overlying the travel plane defined by the rollers 32 in the station 31 and is journalled at one end in the wall 45 and at its right end in a support wall 56 for suitable rotation which may be brought about by a manual crank 57 connected to the shaft 55 or any other suitable rotary drive means. This screw-thread drive arrangement permits the user of the machine 10 to adjustably set the horizontal location of the stop means 47 within the girth wrapping station 31 as necessary.

Following the girth wrapping station 31 in the direction of advance of an article through the machine is a side wrapping station 60 for folding and tucking the opposed side portions or tube ends of the plastic film 12 already wrapped in tube fashion in the girth wrapping station. The side wrapping station 60 comprises a pivotally adjustable, but normally horizontally disposed, belt conveyor 61 supported between laterally spaced rollers 62 for receiving the article 19 from the girth wrapping station 31 and transporting it to a subsequent downstream discharge conveyor 63 positioned at the exit end of the machine. To support the article 19 for horizontal passage from the rollers 32 in the station 31 onto the side wrapping station conveyor 61, there is provided a transversely extending roller 64 between the forwardmost roller 32 and the lead end of the conveyor 61. The support roller 64 extends between transversely spaced beveled guides facing the advancing article 19 for supporting the overhanging side ends of the film wrap as the article passes into the station 60. There is also provided in the side wrapping station 60 a pair of transversely spaced upstanding guide walls 65, which are resiliently biased, for providing bottom support to the transversely extending tube ends of the film wrap. Overlying each of the guide walls 65 is a vertically movable folder and guide wall device 66 comprising a pair of horizontally, parallel extending bars 67 and 68, one on top of the other. When the folder and guide device 66 descends, the lower bar 67 grips the adjacent transversely extending film end against the resiliently disposed guide wall 65 for folding the film end downward along the corresponding side of the tray 20 and the upper bar 68 serves as a guide wall against the adjacent side edge of the tray 20 to prevent possible transverse shifting of the article 19 in the side wrapping station. Width adjustment of the transversely spaced guide walls 65 and folder and guide devices 66 may be suitably provided to accommodate the particular width of the tray 20 employed. Further elements and operation of the side wrapping station 60 are described below in connection with the operation of the machine 10.

Figure 2:
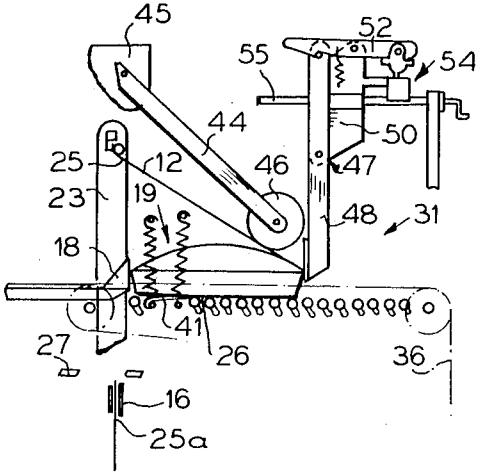

FIGS. 2–7, in conjunction with FIG. 1, illustrate the operation of the film feed station 22 and the girth wrapping station 31 for end-to-end wrapping of the article 19 with the stretch plastic film 12. With reference to FIGS. 1 and 2, a suitable drive means in the machine 10 causes one feed finger 18 to move to the right across the top of the feed table 17, passing an article 19 to be wrapped forwardly into the girth wrapping station. As the feed finger 18 moves forward, the film clamp and support bar 23 moves upwardly to the position shown in FIG. 1 with the mechanism 24 gripping the upper edge 25 of the film. With the clamp and support arm 23 moved to its upper position, a curtain is formed with the film 12 transversely across the path of advance of the article 19. The blower 28 causes a stream of air to billow the film curtain ahead of the advancing article to prevent folds from forming in the film. The article 19 is advanced into and through the curtain as the feed finger 18 proceeds toward its forward end stroke along the table 17. The blast of air from the blower 28 also causes moving air to be kept between the tray and its contents to reduce snagging between the film and the article 19. As the article 19 advances into the girth wrapping station, more film is fed by feed rolls 13 in response to tray length sensing mechanisms.

After the correct amount of film is fed, the knives 27 are actuated, such as by a spring-release tripped by a limit switch actuated by a photocell cycle programmer or the movement of the article 19 on the table 17. The knife action forms the lower edge 26 on the sheet of exposed plastic film 12. As the article 19 continues to advance onto the rollers 32 in the girth wrapping station, the lower edge 26 of the film 12 is, as shown in FIG. 2, pressed by the rollers 32 and the pressure plate 41 of the clamping mechanism 40 against the bottom of the tray 20. The spring biased free end of the pressure plate 41 primarily serves to grip the free end of the film lower edge 26 firmly against the bottom of the tray 20 to prevent slippage. The upper edge 25 of the film 12 remains gripped by the clamping mechanism 24 of the movable arm 23 and this end of the film is maintained in position by the airstream from the blower 28.

The advancing movement of the article 19 in the girth wrapping station 31 is halted by abutment of the lead end of the tray 20 against the locked stop bar 48. The roller arm 44 becomes pivoted as the result of the advancing movement of the article 19 such that its roller 46 rides along the upper surface of the film 12 to pull the film taut and hold down the front of the article 19.

Figure 3:
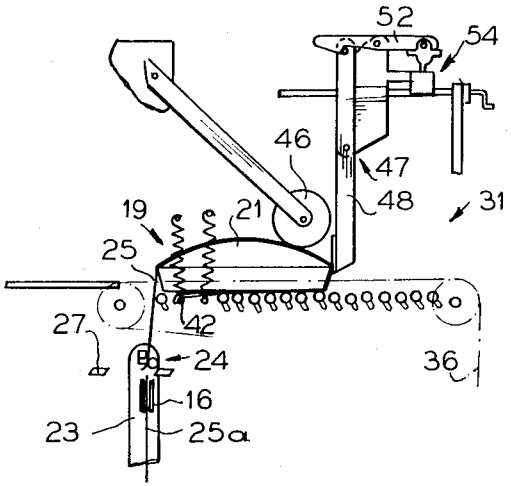

With reference to FIG. 3, the feed finger 18 retracts upon delivery of the article 19 into the girth wrapping station 31 and the film clamp and support arm 23 is lowered, causing the film 12 to be draped about the tail end of the article 19. This movement of the clamp and support arm 23 causes a tensioning action on the film over the top of the article 19. At this time, the weight and adhesiveness of the free-wheeling roller 46 on the top of the article 19 also serves to prevent backward tilting or sliding of the article as a result of the tensioning in the film 12 due to the downward pulling force exerted by the arm 23 and bar 37. The air blower 28 may be, although an automatic operation usually is not, shut off after the article 19 is advanced to this wrapping position in the station 31.

Figure 4:
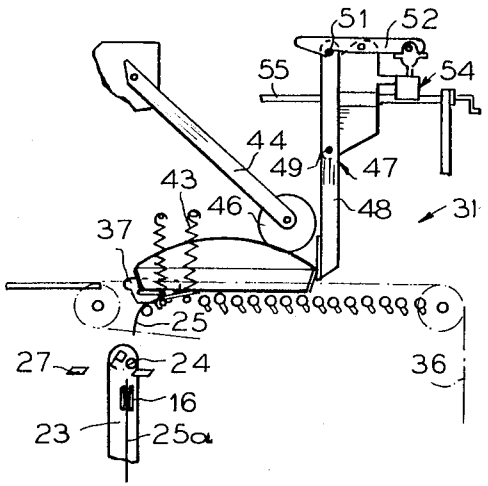
FIGS. 2–7 are each schematic, cross-sectional side elevational views showing, in sequence, the stages of wrapping operation in the girth wrapping station of the machine of FIG. 1.

Between FIGS. 3 and 4, the clamping mechanism 24 of the bar 23 releases the film 12 such that a free-hanging film portion momentarily extends downwardly from the tail end of the tray 20. The bar 23 travels further downwardly to engage an upper edge 25*a* of a next sheet of plastic film to be drawn from the feed rollers 13 in or just above the guide fingers 16 upon advancement of the other feed finger 18 along the table 17.

As shown in FIG. 4, the drive chain 36, which has been or has begun running, advances the underfolder bar 37 to adjacent the tail end of the article tray 20, whereupon the underfolder bar grips the free hanging portion of the film 12 and stretches the film longitudinally across the top, tail, and bottom of the article tray 20 to produce a self-sealing action on the stretch film. As the underfolder bar 37 continues to advance forwardly over the suppor rollers 32, it passes between the bottom of the tray and the spring biased pressure plate 41, such that the pressure plate releases its clamp of the lower film edge 26 against the bottom of the tray. Preferably, the free-hanging portion of the film is of a sufficient length that the underfolder bar 37 causes it to overlap with the lower edge of the film to produce a lap joint seal along the bottom of the article tray 20. The roller 46 and abutment bar 48 serve to prevent backward tilting or undesirable forward shifting of the article 19 during this wrapping and sealing step.

Figure 6:
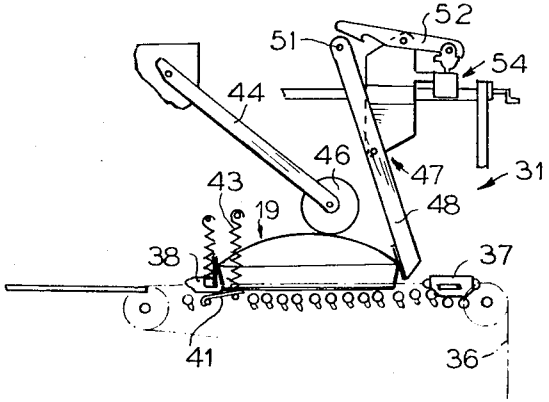
Figure 5:
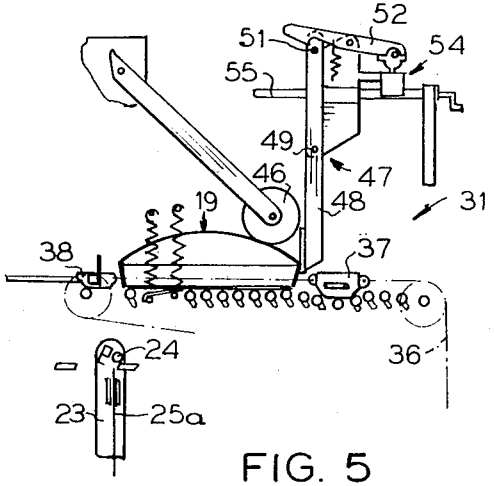

As shown in FIG. 5, the drive chains 36 draw the underfolder bar 37 past the lead end of the article, whereupon this movement of the underfolder bar 37 trips a suitable sensing mechanism, such as a limit switch, which actuates the solenoid of the locking means 47, causing the solenoid piston to descend and raise the grip arm 52 to release its engagement with the lock pin 51 of the abutment bar 48. At this point, the now longitudinally wrapped and sealed article 19 is free to be advanced over the support rollers 32 and out of the girth wrapping station. The pusher bar 38 is brought up behind the article 19 by the drive chains 36 and, as shown in FIG. 6, advances the wrapped article 19 horizontally out of the girth wrapping station. This advancing movement of the longitudinally wrapped article 19 is unimpeded by the abutment bar 48 since it is now released and free to pivot about its transverse pivot rod 49.

Figure 7:
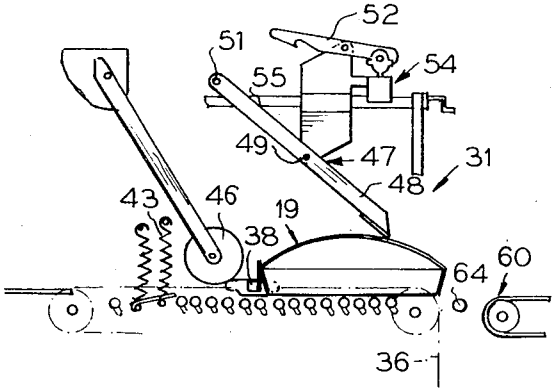

As shown in FIG. 7, the lower free end of the abutment bar 48 rides over the top of the wrapped article 19 as the articles advanced into the side wrapping station 60. This lower end of the abutment bar 48 is preferably formed with a suitable non-adhering surface, such that the article's engagement with the abutment bar does not cause tearing of the film 12 but rather serves to smooth out possible wrinkles formed in the film and further assure the tautness of the film over the top of the article 19.

As the longitudinally wrapped article 19 advances into the side wrapping station 60, the opposed transverse side ends of the film 12 are formed in the manner of open tubes. These tube ends of the film extend transversely outward from the girth wrapped article 19 for pick up by the guide walls 65. When the wrapped article exits the girth wrapping station 31, the lower end weight of the abutment bar 48 causes the bar to vertically right itself and the pusher bar 38 triggers a suitable sensing mechanism, such as a limit switch, to deactivate the solenoid 54 and cause the gripper arm 52 to again lockingly engage with the upper end pin 51 of the bar 48 in preparation for a subsequent article to be wrapped in the station 31.

Figures 8, 9, 10, 11, 12, 13, 14:
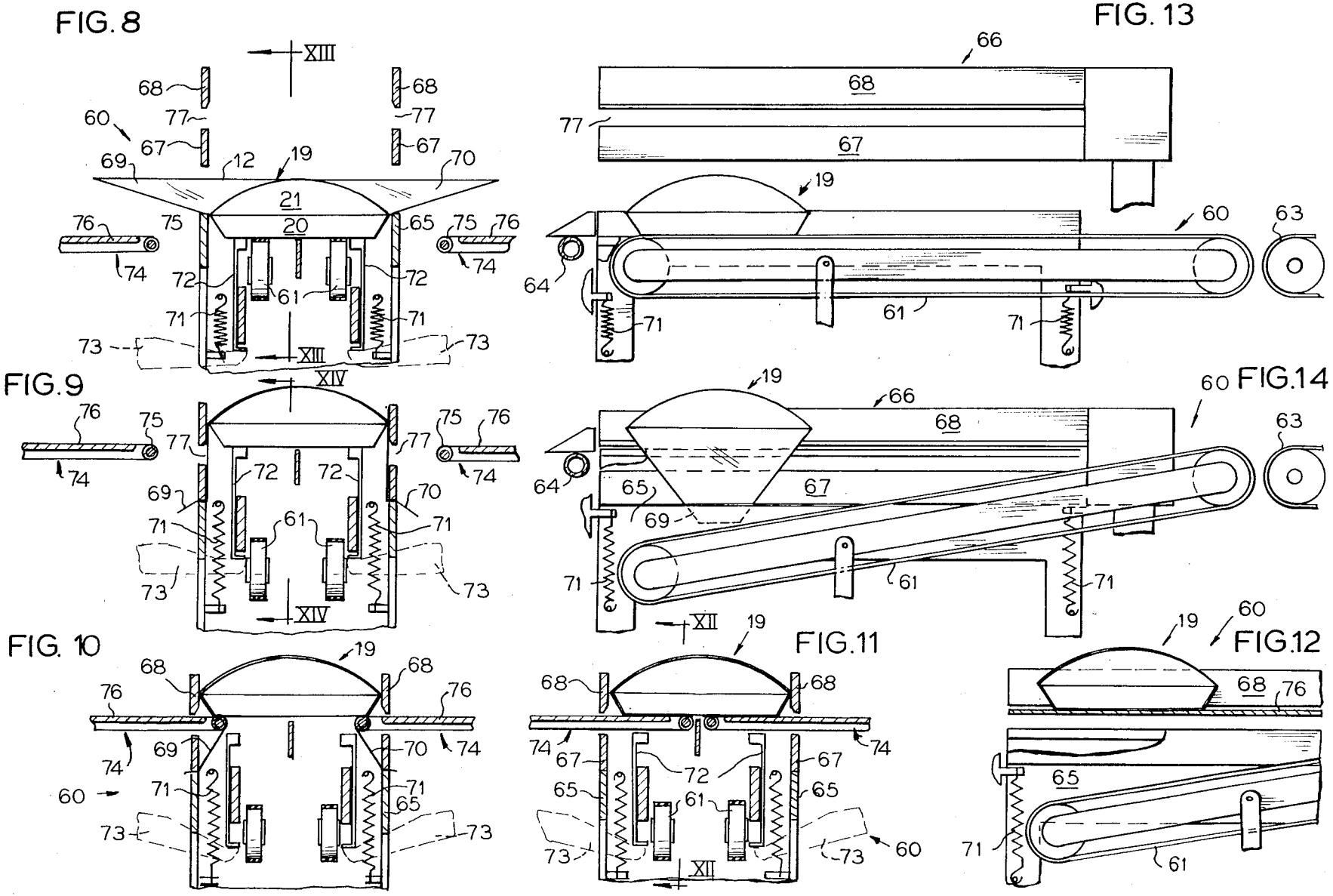
FIGS. 8–11 are each schematic, cross-sectional side elevational views illustrating the stages of wrapping operation in the side wrapping station of the machine of FIG. 1.
FIG. 12 is a cross-sectional view taken along the lines XII—XII of FIG. 11.
FIG. 13 is a cross-sectional view taken along the lines XIII—XIII of FIG. 8.
FIG. 14 is a cross-sectional view taken along the lines XIV—XIV of FIG. 9.

FIGS. 8–14 illustrate the operation of the side wrapping station 60. As shown in FIGS. 8 and 13, opposed overhanging end edges 69 and 70 of the film 12 in the form of open tubes are disposed on the upper surfaces of the guide walls 65. Each of the guide walls 65 is disposed by virtue of spring mountings 71 to be resiliently biased upwardly relative to the horizontal travel path of the tray through the machine 10 from their lowermost as shown in FIG. 10. The conveyor belt means 61, which as shown here may be in the form of a pair of transversely spaced conveyor belt assemblies, serves to receive the end-to-end wrapped package 19 from the station 31 and conduct it forwardly a short distance into the side wrapping station 60, whereupon the conveyor 61 retracts or descends in order to prepare for side end folding and tucking of the film 12.

With reference to FIGS. 9 and 14, side end folding of the film 12 commences with the folding and guide devices 66 being passed downwardly on opposed transverse sides of the article 19, such that the end folder bars 67 clamp the film side end edges 69 and 70 against the upper surfaces of the guide walls 65 and draw these overhanging film portions downwardly along with the resiliently biased guide walls 65 to pull and stretch the film tautly in the transverse direction across the top of the article 19. The rearward facing guide rolls 62 of the belt conveyor 61 are mounted in connection with the guide walls 65 such that, as the guide walls 65 are lowered, the rearward facing end of the conveyor 61 is also lowered out of engagement with the bottom of the article tray 20. The article tray 20 remains disposed in place substantially in line with its travel path through the machine 10 by coming to rest on a pair of longitudinally extending, transversely spaced support bar frameworks 72 positioned beneath the bottom of the article tray 20. When the folder and guide device 66 has fully descended, the folder bars 67 will have passed beneath the bottom of the tray 20 and the guide bars 68 are disposed adjacent or against the upper edge side corners of the tray 20 to position the tray against transverse shifting during the subsequent side wrapping and sealing operation. It will be understood that the overhanging side edges 69 and 70 of the film 12 are, as shown in FIG. 9, no longer in the form of open tubes, but such tubes are collapsed and the film is resiliently tensioned downwardly from the opposed side corners of the tray 20.

With reference to both FIGS. 8 and 9, the side wrapping station 60 further includes a corresponding pair of controllably actuated lever arms 73 which respectively serve to carry the support framework members 72 between upper and lower positions. FIGS. 8 and 9 illustrate the lever arms 73 in their laterally disposed positions whereupon the support frameworks 72 are disposed in their uppermost, normal position within the station 60. These lever arms 73 are pivotable about horizontally disposed axes via suitable drive means to lower the support frameworks 72 away from the bottom of the tray as will be further described below. Also shown in these FIGS. 8 and 9 is a pair of transversely extending underfolder rams 74 disposed for transverse lateral back and forth movement on either side of the article 19 being wrapped. Each of these underfolder rams 74 comprises a lead end free-wheeling film roller 75 followed by a planar plate 76, all attached to a suitable support framework. The vertical spacing between the upper guide bar 68 and end folder bar 67 on the device 66 defines a horizontally directed gap 77 which becomes laterally aligned with the adjacent underfolder ram 74 when the devices 66 are lowered as shown in FIG. 9. The gaps 77 are of a thickness greater than the vertical thickness of the underfolder ram frameworks.

Between FIGS. 9 and 10, the underfolder rams 74 are activated, such as by a suitable sensing means triggered as the result of the lowering of the end folder and guide devices 66, to pass toward and through the adjacent gaps 77 for engaging against and directing inward beneath the bottom of the article tray 20 the adjacent intermediate portions of the overhanging film ends 69 and 70. Simultaneous with the rollers 75 of the underfolder rams riding under the bottom of the tray 20, the lever arms 73 are lowered, as shown in FIG. 10, so that the support frameworks 72 pass downward beneath the bottom of the tray 20 and out of the way of further lateral inward movement of the underfolder rams. At this point in the operation as shown in FIG. 10, the lead roller 75 of the underfolder ram 74 cause a tensioning and stretching action on the overhanging film portions 69 and 70 due to the resilient clamping of the film ends between the side folder bars 67 and the guide walls 65. Such stretching of these film edges causes a self-sealing action on the film around the sidewalls and bottom corners of the article tray 20, as well as transversely across the top of the wrapped article 19 to produce side wrapping and sealing of the article 19 with the film 12.

With reference to FIGS. 11–12, further inward movement of the underfolder rams slips the free-hanging portions of the overhanging side film edges 69 and 70 out from between the end folder bars 67 and guide walls 65 to drive these film portions inward and upward against the bottom of the tray 20 and the girth wrap of plastic film thereover. The underfolder rams 74 each stop short of the longitudinal centerline of the tray 20, as shown in FIG. 11, and, preferably, the length of the overhanging film portions 69 and 70 is such that these film portions are fully pressed against the bottom of the tray when the underfolder rams complete their inward strokes.

After the article 19 has been fully wrapped transversely in the above manner, the movable elements of the station 60 return to their initial positions. Accordingly, the underfolder rams laterally retract outward away from the adjacent guide walls 65 and the lever arms 73 return the support frameworks 72 into engagement with the bottom of the tray 20 at about the same time that the lead rollers 75 of the underfolder rams 74 withdraw from engagement with the bottom of the tray. Finally, the folder and guide devices 66 are elevated, raising the guide walls 65 to their uppermost positions under the action of the springs 71 and elevating the belt conveyor means 61 for return of driving engagement with the wrapped article 19. The conveyor 61 is then re-activated and the fully wrapped article 19 is conducted to the discharge belt conveyor 63 for exit from the machine 10. The discharge conveyor 63 may be heated for some post-wrapping film shrinkage to assure complete sealing and tautness.

The process of FIGS. 1–12 operates continuously in consecutive sequence for each individual article to be wrapped in the machine 10. In this manner, a seriatim flow of articles fully wrapped and sealed in stretch film may be produced by the machine 10. It will be noted that the mechanisms of the machine 10 are particularly adapted for folding, wrapping, and sealing articles or packages in stretch plastic film whereby the film is tensioned or stretched to produce a self-contained wrapped and sealed product.

Figure 15:
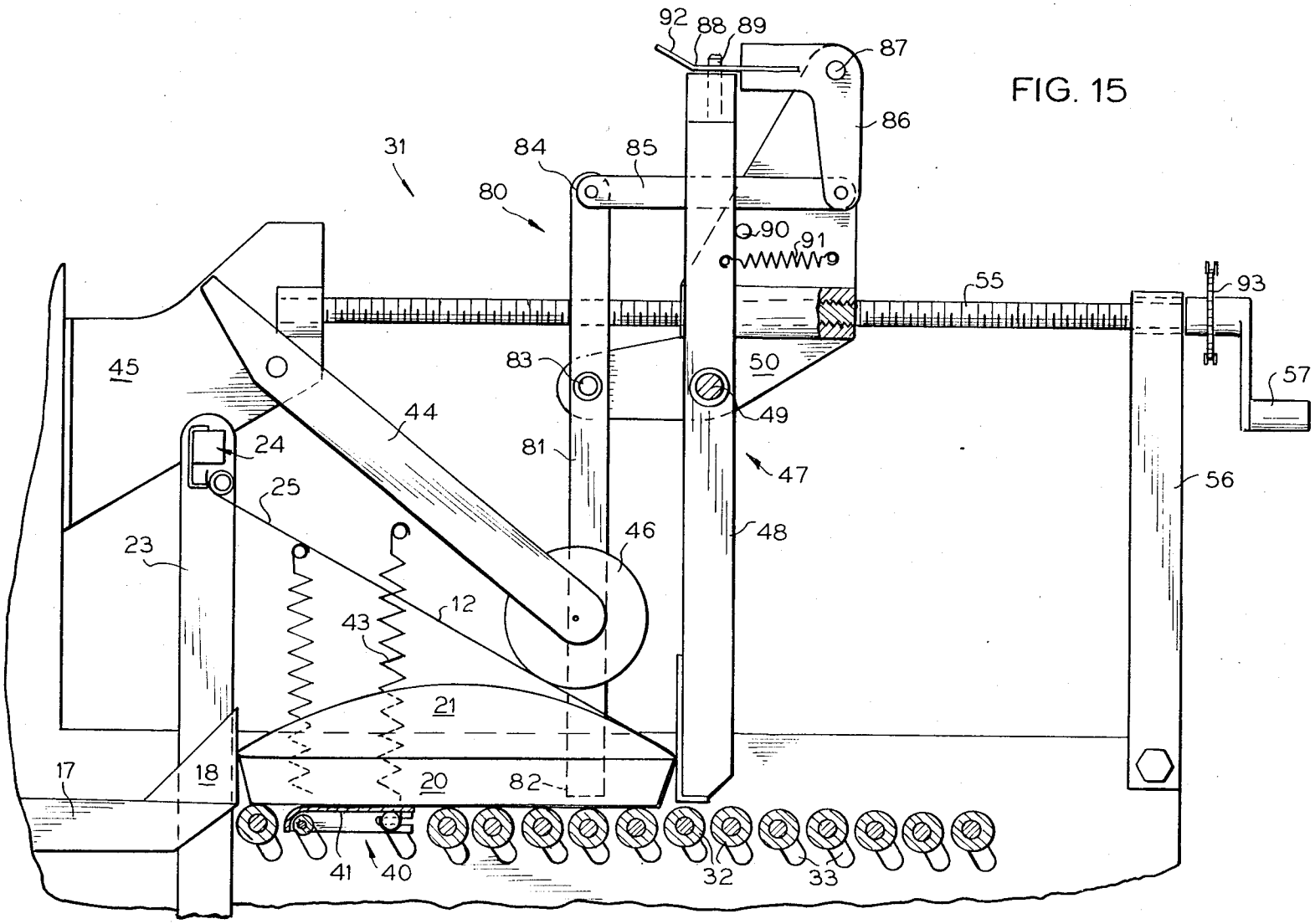
FIG. 15 is a fragmentary, partly schematic, cross-sectional side elevational view of a further embodiment releasable stop means for use in the girth wrapping station of the machine of FIG. 1.

FIG. 15 illustrates a further embodiment of the releasable stop means 47 used in the girth wrapping station 31. Many of the elements shown in FIG. 15 are identical with corresponding means described above and these repeated elements retain their former reference numerals. The stop means shown in FIG. 15 is a fully mechanically operating device employing a lever action linkage system 80 which enables the abutment bar 48 to automatically become locked in its upright position and released therefrom as a result of triggering by passage of the underfolder bar means 37 across the horizontal travel path through the station 31 defined by the support rollers 32. The linkage system 80 comprises a normally vertically upright trigger arm 81 having a lower end 82 disposed in the article travel plane of the station 31 for engagement with a suitable cooperating surface formed on the underfolder bar 37. The trigger arm 81 is pivotable about a transversely directed pivot pin 83 extending transversely outward from the carriage bracket 50 and connected intermediately of the trigger arm 81. An upper end 84 of the trigger arm is pivotally connected to one end of a horizontally directed link 85, the other end of which is pivotally pinned to the lower end of a toggle link 86. The toggle link 86 is mounted for rotation about a pivot pin 87 extending transversely outward from the upper end of the carriage bracket 50. A substantially longitudinally directed latch plate 88 extends outward from the upper free end of the toggle link 86 and is formed with a suitable opening for receiving therethrough an upright lock pin 89 extending upward from the top of the abutment bar 48. An abutment pin 90 is formed on the bracket 50 to extend transversely outward and functions to limit leftward movement of the abutment bar bottom end, so that the abutment bar 48 is properly located in an upright position for latching. A spring connection means 91 serves to bias the abutment bar 48 toward engagement against the stop 90 such that the abutment bar is normally biased to its upright position for latching.

As the underfolder bar 37 passes beneath the bottom of the article 19 being end-to-end wrapped in the station 31, the cooperating surface thereof engages against the lower end 82 of the trigger arm 81 causing it to move forward or rightward as shown in FIG. 15. The subsequent rotation of the upper end 84 of the trigger arm 81 draws the connecting link 85 rearward, thus rotating the toggle link 86 in a clockwise direction and removing the latch plate 88 from engagement with the lock pin 89. Once the latch plate 88 is released from the lock pin 89, the abutment bar 48 may be rotated counterclockwise against the bias of the spring 91, whereupon the lower end of the abutment bar 48 no longer provides a stationary stop to further travel movement of the article 19 and is free to ride over the top surface of the end-to-end wrapped article. As explained above, the pusher bar 38 follows passage of the underfolder bar 37 through the station 31, causing the end-to-end wrapped article to be advanced into the side wrapping station 60. As the article 19 advances horizontally through the station 31, the lower end of the abutment bar 48 rides over the top surface of the film 12 and is pivoted relatively counterclockwise from its normal upright position. During this time, the lower end of the trigger arm 81 is no longer engaged by the cooperating surface of the underfolder bar 37 and, under its own weight, pivots back to its normal upright position, which causes the toggle link 86 to rotate back counterclockwise about the pin 87. As the abutment bar 48 is rotated clockwise about its pivot rod 49, upon discharge of the end-to-end wrapped article into the side wrapping station 60, a bevel cam surface 92 formed on the lead end of the latch plate 88 enables the latch plate to ride over the upper end and lock pin 89 of the abutment bar 48 until the lock pin 89 is again received in the latch plate opening, such that the abutment bar 48 is again locked in its upright position for halting further advance of a subsequent article to be wrapped in the station 31.

As discussed above and shown in FIG. 15, the carriage bracket 50 is disposed for adjustable horizontal movement within the station 31 via a screw drive arrangement which may be manually operated via the crank 57 or motor-driven via a suitable gear train arrangement referred to at 93.

Although various minor modifications may be suggested by those versed in the art, it should be understood that I wish to embody within the scope of the patent warranted hereon all such modifications as reasonably and properly come within the scope of my contribution to the art.

I claim as my invention:

1. A method of automatically stretch-sealing a tray in a sheet of resilient stretch plastic film comprising:

drawing said film sheet by a free upper edge thereof across a horizontal travel path for said tray, advancing said tray into said film sheet onto a first support means such that a free bottom edge of said film sheet is folded beneath a bottom of said tray adjacent the lead end of said tray and said film is extended over the top of the tray, fixedly clamping a portion of said bottom edge against said tray bottom with a second support means for said tray in the form of an upwardly biased pressure plate, contacting the top of said tray and said film sheet with a free-wheeling roller such that tensioning of said film sheet occurs beneath said roller but said tray is prevented from tilting, tensioning and streching said film sheet wholly about said tray from said pressure plate to said film sheet upper edge by downwardly pulling said film sheet upper edge wherein said film sheet freely moves beneath said roller, releasing said upper edge such that said upper edge extends downwardly from the tail end of said tray, and advancing an underfolder bar means horizontally between said tray bottom and said pressure plate for gripping said downwardly extending released upper edge such that the tension in said film sheet is not substantially relieved and stretching said upper edge beneath said tray bottom to form a longitudinally stretch-sealed wrapped product.

2. The method of claim 1, further comprising:

resiliently gripping transversely opposed side edges of said film overhanging said longitudinally wrapped product and simultaneously folding said side edges to extend downwardly from and along opposed transverse sides of said tray and laterally engaging said downwardly extending side edges with retractable underfolder ram means to stretch said film transversely about said tray and contents and tuck said side edges beneath said tray bottom to form a completely wrapped product.

3. The method of claim 1, further comprising:

supporting said tray against further advance during advancement of said underfolder bar means beneath said tray bottom.

4. The method of claim 1, further comprising:

lapping said upper edge with said bottom edge beneath said tray, passing said underfolder bar means between said bottom edge of said film sheet and said pressure plate.

5. Apparatus for automatically stretch-sealing a tray in a sheet of resilient stretch plastic film comprising:

means for advancing sid tray horizontally onto a support surface in a girth wrapping station, arms means connected to a vertical reciprocation drive and having a means for gripping said film sheet by a free upper edge thereof, said arm means drawing said film sheet upwardly across the path of advance of said tray such that as said tray is advanced a free bottom edge of said film sheet is folded beneath a bottom of said tray adjacent the lead, end of said tray and the film is extended over the tray, pressure plate means in said girth wrapping station for acting as a further support surface beneath said tray and means for upwardly biasing said pressure plate to clamp a portion of said sheet bottom edge fixedly against said tray bottom, means for supporting a free-wheeling roller for free vertical movement upon the top of said of said tray and said film sheet in said girth wrapping station such that tensioning of said film sheet occurs beneath said roller but said tray is prevented from tilting, said arm means drawing said said sheet upper edge transversely downwardly behind said tray across its path of advance beneath the tail end of said tray such that said film sheet is tensioned and stretched wholly about said tray from said pressure plate means to said sheet upper edge and said film sheet freely moves beneath said roller, means for releasing said mens gripping said sheet upper edge after said upper edge has been drawn downwardly behind said tray beneath the tail end thereof, and means for conducting a bar from behind said tray between said tray bottom and said pressure plate means in the direction of the path of advance of said tray to cause said bar to engage said released sheet upper edge such that the tension in said film sheet is not substantially relieved and stretch said sheet upper edge beneath said tray bottom to form a longitudinally stretch-sealed wrapped product.

6. The apparatus of claim 5, further comprising a releasable stop means in said girth wrapping station for holding said tray against horizontal advancement during the longitudinal wrapping.

7. The apparatus of claim 6, wherein said stop means is adjustably positioned in said girth wrapping station to accommodate trays of different sizes.

8. The apparatus of claim 5 further comprising a means for conducting said longitudinal wrapped tray out of said girth wrapping station.

9. The apparatus of claim 8, further comprising a side wrapping station downstream of said girth wrapping station for receiving passage of said longitudinal wrapped tray therefrom, said side wrapping station comprising a vertically reciprocable clamping means for resiliently clamping and folding downward opposed side edges of said film sheet transversely overhanging said longitudinal wrapped tray and a retractable tucker means being adapted for lateral movement beneath and along the bottom of said tray to stretch said film sheet by engagement of said downwardly folded film side edes and tuck said side edges beneath said tray bottom.

10. The apparatus of claim 9, wherein said side wrapping station further comprises retractable carrier means for supporting said tray, said carrier means supporting said tray in said side wrapping station during operation of said clamping means to clamp and fold the film side edges and being movable to drop out of engagement with said tray to transfer support to said retractable tucker means during stretching and tucking of said film side edges beneath said tray bottom.

11. The apparatus of claim 5, wherein said film sheet is of sufficient length to overlap with said bottom edge beneath said tray, said bar advancing said upper edge between said bottom edge and said pressure plate means to form a lap joint beneath said tray.

* * * * *